United States Patent [19]

Cetrone

[11] Patent Number: 4,652,064

[45] Date of Patent: Mar. 24, 1987

[54] COMPOSITE ELECTRONIC AND FLUID CONNECTOR

[76] Inventor: Vincent Cetrone, 5232 Tod Ave. SW., Warren, Ohio 44482

[21] Appl. No.: 801,282

[22] Filed: Nov. 25, 1985

[51] Int. Cl.[4] ..... H01R 13/22

[52] U.S. Cl. ..... 339/16 R; 339/48; 339/60 M; 339/61 M; 339/91 R

[58] Field of Search ..... 339/15, 16 R, 48, 49 B, 339/60 R, 60 M, 61 R, 61 M, 91 R; 285/119, 137.1, 65, 70, 73

[56] References Cited

U.S. PATENT DOCUMENTS

| | | | |
|---|---|---|---|
| 2,275,762 | 3/1942 | Horton | 339/60 M |
| 2,857,576 | 10/1958 | Ueckert | 339/16 R |
| 3,453,007 | 1/1967 | Roland | 285/137 |
| 3,640,552 | 2/1972 | Demler, Sr. et al. | 285/110 |
| 3,673,541 | 6/1972 | Volinskie | 339/16 R |
| 3,753,575 | 8/1973 | Tracy | 285/137.1 |
| 4,076,279 | 2/1978 | Klotz et al. | 285/26 |
| 4,247,135 | 1/1981 | Weirich | 285/137.1 |

*Primary Examiner*—John McQuade

*Attorney, Agent, or Firm*—Harpman & Harpman

[57] ABSTRACT

A multiple passage snap-together coupling for releaseably connecting hose or electrical conductor ends, the coupling having yieldable body members arranged for snap-together engagement and incorporating tubular grommets positioned in the snap-together body members and arranged for sealing registry when the body members are engaged. The tubular grommets receive and are secured to pipes, tubes, electrical conductors and the like the coupling being sealed against leakage when connections are effected.

3 Claims, 3 Drawing Figures

COMPOSITE ELECTRONIC AND FLUID CONNECTOR

BACKGROUND OF THE INVENTION

1. Technical Field

This invention relates to multiple passage plug-in couplings for releasably connecting hose, tubes, and electrical conductors.

2. Description of the Prior Art

Prior structures of this type usually employ rigid body members have yieldable nipple-like connections positioned therethrough to which hose, tubes, and pipes may be connected.

See for example U.S Pat. Nos. 3,453,007, 3,640,552, 3,673,541, and 4,076,279.

The present invention provides a simple, inexpensive, snap-together coupling providing positive and effective sealing connection between fluid, air, or vacuum hoses and/or tubes and electrical conductors.

SUMMARY OF THE INVENTION

A composite electrical fluid air or vacuum connector comprising a pair of resilient body members formed of a synthetic resin or the like in which tubular grommet-like fittings are arranged in spaced relation and in registering position when the resilient body members are engaged one against the other in a snap-in manner. The tubular grommet-like fittings provide simple and inexpensive sealing connection with hoses or tubes for hydraulic fluids, air pressure, vacuum lines and the like as well as electrical conductors so that a multiplicity of such hoses, tubes, or conductors can be simultaneously and sealingly connected in an environmentally secure coupling, as for example in a multiple-purpose wiring and/or air pressure and vacuum hose harness as used in the automotive industry.

DESCRIPTION OF THE PREFERRED EMBODIMENT

Figure 1:
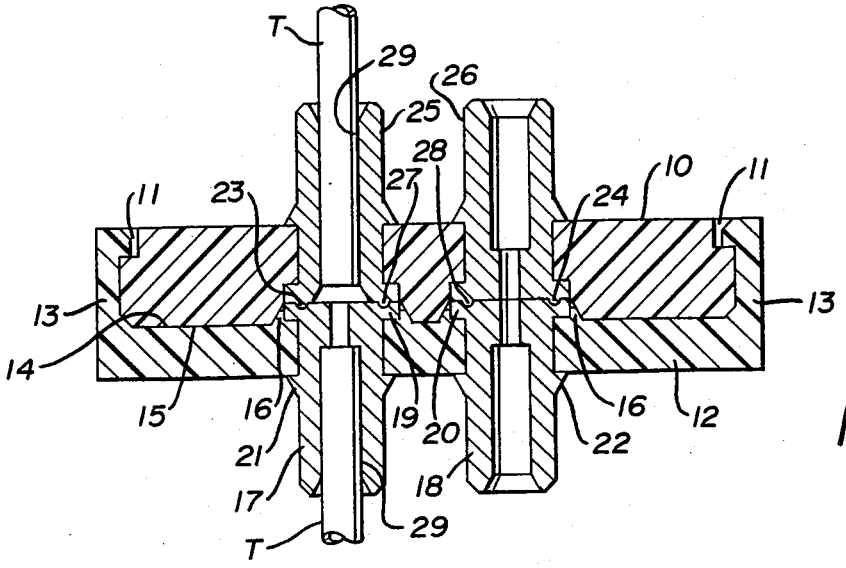
FIG. 1 is a vertical section through the connector.

In the form of the invention chosen for illustration herein, the connector comprises a first resilient body member 10 having at least a pair of oppositely disposed recessed shoulders 11 formed thereon and a second resilient body member 12 having at least a pair of flanged arms 13 thereon positioned and arranged for snap-in registry in the recessed shoulders 11 of the first resilient body member 10. The body members 10 and 12 have substantially flat engaging surfaces 14 and 15 respectively and one or both of the engaging surfaces 14 and 15 of the resilient body members 10 and 12 may be bowed toward one another so that engagement of the flanged arms 13 on the recessed shoulders 11 distorts one or both of the resilient body members 10 and 12 and move the surfaces 14 and 15 tightly against one another as best illustrated in FIG. 1 of the drawings.

By referring thereto, it will be seen that the resilient body member 12 has upstanding annular tapered ribs forming configurations 16 surrounding each of a pair of first tubular grommets 17 and 18 respectively, which are positioned through apertures in the resilient body member 12 and secured thereto as occurs when the rigid tubular grommets 17 and 18 formed of hardened plastic or metal or the like are positioned in a mold in which the resilient body member 12 is subsequently formed. The tubular grommets 17 and 18 have annular flanges 19 and 20 thereon positioned in and secured to the annular configurations 16 and tapered annular ribs 21 and 22 engaging the outer lower surface of the resilient body member 12. Annular grooves 23 and 24 are formed in the flanges 19 and 20.

Still referring to FIG. 1 of the drawings, it will be seen that a pair of secondary tubular grommets 25 and 26 respectively are secured in apertures in the first resilient body member 10 forming passageways therethrough and positioned for registry with tubular grommets 17 and 18. Annular rounded ribs 27 and 28 are respectively formed on the lower flanged surfaces of the secondary tubular grommets 25 and 26 and sealingly engage the annular grooves 23 and 24 in the tubular grommets 17 and 18.

The registration of the annular ribs 27 and 28 in the annular grooves 23 and 24 insure the vertical alignment of the tubular grommets and it will also be seen that the lower ends of the secondary tubular grommets 25 and 26 are flanged and recessed in recesses in the lower flat engaging surface 14 of the first resilient body member 10 so that positive registration of the tubular grommets which form the actual connections are insured.

In the left hand portion of FIG. 1 of the drawings, a pair of flexible tubes T are shown secured in the tubular grommets 17 and 25 respectively as by a suitable adhesive 29. It will be understood that if the flexible tubes T are metal, their opposed ends may be flared as shown in the lower portion of the secondary tubular grommet 25 and it will be understood that the flexible tubes, which may be plastic or metal or woven hoses are adapted to contain and deliver or direct air under pressure a partial vacuum or various liquids as desired. On the right hand of FIG. 1 of the drawings, the tubular grommets 18 and 26 are illustrated as formed of metal and have modified bore configurations so that semi-flexible tubes, or pipes, not shown, can be secured therein as by solder, adhesives or various cements as known in the art.

Figure 2:
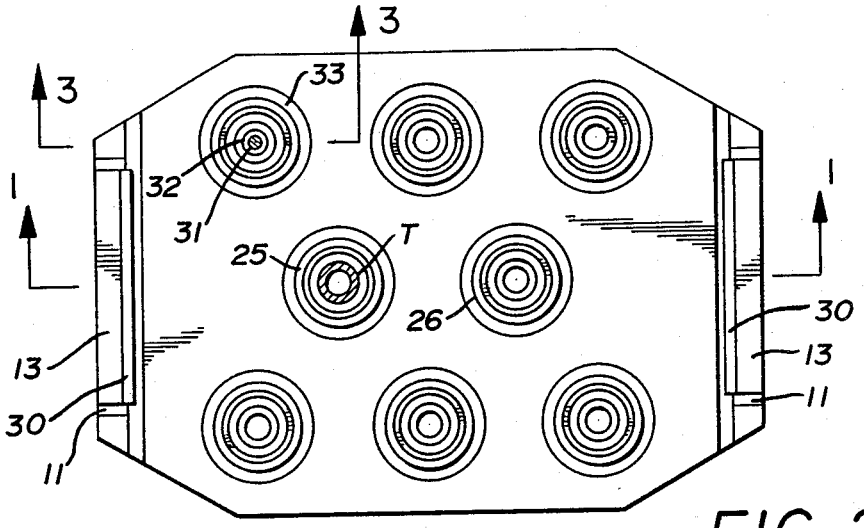
FIG. 2 is a top plan view of the connector.

By referring now to FIG. 2 of the drawings, a top plan view of a typical comprehensive electrical fluid, air or vacuum connector may be seen wherein eight tubular grommets are illustrated with the center pair being those represented in the cross section comprising FIG. 1 of the drawings.

Still referring to FIG. 2 of the drawings, it will be seen that the arms 13 on the secondary resilient body member 12 have their flanged ends engaged on the recessed shoulders 11 of the first resilient body member 10 at the opposite ends thereof and it will be seen that the upper inner edges of the inturned flanges on the arms 13 are tapered as at 30 to facilitate the snap-in registry of the resilient body members 10 and 12 respectively.

Figure 3:
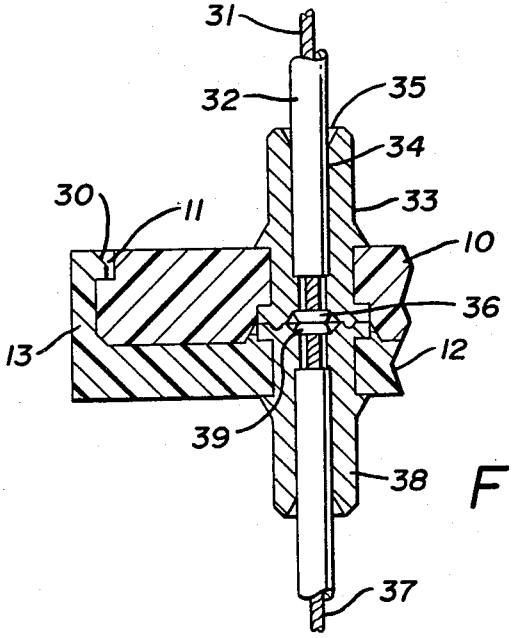
FIG. 3 is a vertical section through a portion of a connector showing a modified electrical conductor connection.

By referring now to FIG. 3 of the drawings, a vertical section through a portion of the connector illustrated in FIG. 2 may be seen and wherein an electrical conductor 31 having a synthetic resin insulating sheath 32 is positioned in a tubular grommet 33 which has a tubular bore therein substantially the same as the tubular grommet 26 hereinbefore referred to. The tubular sheath 32 is secured to the tubular grommet 33 by an adhesive 35 or may be heat sealed thereto when the tubular grommet 33 is plastic. The conductor 31 extends out of the lower end of the sheath 32 and has a fitting 36 secured thereto which has a flattened, preferably slightly bowed lower end forming an enlarged contact. A second electrical conductor 37 is positioned through a tubular grommet 38 in vertical registry with the tubular grommet 33 and the electrical conductor 37 has a contact fitting 39 on its end, the contacts 36 and 39 being distorted somewhat when engaged to insure a suitable, relatively wide area of conduction for an electric current passed through the conductors 31 and 37.

It will be understood that the contacts 36 and 37 are held in stressed, distorted engagement by the snap-in registry of the resilient body members 10 and 12 as held by the arms 13 with their inturned upper ends engaged on the shoulders 11, all as hereinbefore described.

It will thus be seen that a comprehensive electrical, fluid, air or vacuum connector has been disclosed which provides a relatively easy and fast coupling of various conductor means including tubes, hoses, electrical conductors and the like.

Although but one embodiment of the present invention has been illustrated and described, it will be apparent to those skilled in the art that various changes and modifications may be made therein without departing from the spirit of the invention and having thus described my invention, what I claim is:

1. A snap together composite electrical and fluid conduit connector comprising a pair of companion resilient distortable body members having opposing engaging surfaces, each having at least one through aperture extending from said engaging surface to an opposite outer surface thereof, each of said resilient distortable body members having annular tubular grommet receiving configurations in and around said through apertures therein and at least one rigid tubular grommet having annular fastening configurations thereon positioned in each of said through apertures with said annular fastening configurations in registering engagement with said receiving configurations, said tubular grommets having bores receiving said electrical and fluid conduits, registering flanges on said tubular grommets sealingly engaging one another, and engaging fastening means on said resilient distortable body members holding said engaging surfaces of said resilient distortable body members and said registering flanges in sealing engagement with one another.

2. The snap together composite electrical and fluid conduit connector set forth in claim 1 and wherein said grommet receiving configurations around said apertures in said resilient distortable body members comprise upstanding annular distortable tapered ribs on the engaging surface of one of said resilient distortable body members and annular recesses in the engaging surface of the other one of said resilient distortable body members, outturned flanges on said tubular grommets arranged for registry within said upstanding annular ribs and with said annular recesses of said resilient distortable body members respectively.

3. The snap together composite electrical and fluid conduit connector set forth in claim 1 and wherein said opposing engaging surfaces of said resilient distortable body members are bowed toward one another whereby said engaging surfaces are held in distorted sealing relation to one another by said engaging fastening means.

* * * * *